US012485329B2

(12) United States Patent
McDonnell et al.

(10) Patent No.: US 12,485,329 B2
(45) Date of Patent: Dec. 2, 2025

(54) SMART TAG FOR A GOLF CLUB

(71) Applicant: Cobra Golf Incorporated, Carlsbad, CA (US)

(72) Inventors: Michael T. McDonnell, Carlsbad, CA (US); Bryce W. Hobbs, Escondido, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 341 days.

(21) Appl. No.: 18/116,157

(22) Filed: Mar. 1, 2023

(65) Prior Publication Data

US 2024/0293715 A1 Sep. 5, 2024

(51) Int. Cl.
*A63B 60/42* (2015.01)

(52) U.S. Cl.
CPC ..... *A63B 60/42* (2015.10); *A63B 2220/833* (2013.01); *A63B 2225/50* (2013.01)

(58) Field of Classification Search
USPC ..... 473/220–223, 407, 409
See application file for complete search history.

(56) References Cited

U.S. PATENT DOCUMENTS

| | | | |
|---|---|---|---|
| 7,338,785 | B2 | 3/2008 | Lukyanov et al. |
| 7,404,370 | B2 | 7/2008 | Stokkeland |
| 7,485,496 | B2 | 2/2009 | Chien et al. |
| 7,525,137 | B2 | 4/2009 | Walker et al. |
| 7,757,626 | B2 | 7/2010 | Shinya et al. |
| 7,791,854 | B2 | 9/2010 | Chu |
| 7,820,004 | B2 | 10/2010 | Wada |
| 7,892,155 | B2 | 2/2011 | Pearson et al. |
| 7,943,633 | B2 | 5/2011 | Frappier et al. |
| 8,059,959 | B2 | 11/2011 | Kasezawa |
| 8,082,004 | B2 | 12/2011 | Amirnovin |
| 8,155,379 | B2 | 4/2012 | Nozawa |
| 8,298,100 | B2 | 10/2012 | Burnett et al. |
| 8,412,937 | B2 | 4/2013 | Maubach et al. |
| 8,512,162 | B2 * | 8/2013 | Kim ..... G09B 19/0038 473/407 |
| 8,517,850 | B1 * | 8/2013 | Beno ..... A63B 60/42 473/221 |
| 8,636,603 | B2 | 1/2014 | Rauchholz |
| 8,641,546 | B2 | 2/2014 | Rauchholz |
| 8,641,547 | B2 | 2/2014 | Rauchholz |
| 8,641,548 | B2 | 2/2014 | Rauchholz |
| 8,740,181 | B2 | 6/2014 | Prieto Barranco et al. |
| 8,750,407 | B2 | 6/2014 | Cheng et al. |
| 8,870,673 | B2 | 10/2014 | Beno |
| 9,195,781 | B2 | 11/2015 | Savarese |
| 9,227,118 | B2 | 1/2016 | Beno |

(Continued)

FOREIGN PATENT DOCUMENTS

EP 2803062 B1 6/2017

*Primary Examiner* — Nini F Legesse
(74) *Attorney, Agent, or Firm* — Quarles & Brady LLP

(57) ABSTRACT

Systems and methods for golf club fitting include a golf club, a detection unit, and a smart tag. The golf club has a club head, a shaft, and a grip. The smart tag communicates with the detection unit when the golf club is positioned within a detection zone associated with a sensor of the detection unit. The smart tag stores data associated with the golf club, such that the detection unit collects the data associated with the golf club from the smart tag for transmission to a computing device.

19 Claims, 5 Drawing Sheets

(56) References Cited

U.S. PATENT DOCUMENTS

| | | | | |
|---|---|---|---|---|
| 9,403,073 | B2 | 8/2016 | McDonnell | |
| 9,409,071 | B1 | 8/2016 | Beno | |
| 9,427,639 | B2 | 8/2016 | Rauchholz | |
| 9,789,361 | B2 | 10/2017 | Beno | |
| 9,968,826 | B2 | 5/2018 | McDonnell | |
| 9,968,827 | B2 | 5/2018 | Beno | |
| 10,293,235 | B2 | 5/2019 | Beno | |
| 10,315,083 | B1 | 6/2019 | Moreira | |
| 11,135,495 | B2 | 10/2021 | Tuxen | |
| 11,850,490 | B1 | 12/2023 | Destefano | |
| 12,083,397 | B1 | 9/2024 | Demille et al. | |
| 12,097,404 | B2 | 9/2024 | Wycoff | |
| 12,268,941 | B1 | 4/2025 | Demille et al. | |
| 12,274,924 | B2 | 4/2025 | Stubben et al. | |
| 2008/0003215 | A1 | 1/2008 | Bayrock | |
| 2008/0075294 | A1 | 3/2008 | Chatte | |
| 2008/0241048 | A1 | 10/2008 | Kawano | |
| 2010/0194316 | A1 | 8/2010 | Eisenhardt | |
| 2010/0308105 | A1* | 12/2010 | Savarese | G01S 19/19 250/206 |
| 2012/0035003 | A1* | 2/2012 | Moran | A63B 71/06 700/91 |
| 2012/0139729 | A1* | 6/2012 | Savarese | A63B 71/06 340/568.6 |
| 2012/0316843 | A1* | 12/2012 | Beno | G06Q 10/0639 703/2 |
| 2013/0166902 | A1* | 6/2013 | Girard | G07F 7/1075 713/150 |
| 2014/0221118 | A1 | 8/2014 | Meadows | |
| 2016/0303443 | A1* | 10/2016 | Boggs | A63B 53/14 |
| 2019/0344138 | A1* | 11/2019 | Amarant | G06F 18/2413 |
| 2023/0256298 | A1 | 8/2023 | Beach et al. | |
| 2023/0256312 | A1 | 8/2023 | Johnson et al. | |
| 2024/0028786 | A1 | 1/2024 | Presse, IV et al. | |
| 2024/0033599 | A1 | 2/2024 | Johnson et al. | |
| 2024/0216774 | A1 | 7/2024 | Rahman et al. | |
| 2024/0293698 | A1 | 9/2024 | Wycoff | |
| 2024/0325838 | A1 | 10/2024 | Johnson et al. | |
| 2025/0128129 | A1 | 4/2025 | Miller | |
| 2025/0128131 | A1 | 4/2025 | Johnson et al. | |

* cited by examiner

SMART TAG FOR A GOLF CLUB

BACKGROUND

Golfers at any level of experience or skill may be fitted for golf clubs. Often the fitting process takes place in-person at a sporting goods store or a specialized fitting location where trained personnel, i.e., fitters, employ various methodologies to collect and analyze information about the golfer and to provide recommendations for the golfer in selecting golf clubs. During the fitting process, golfers may swing several different golf clubs, each having different specifications. Typically, the golf club specifications are entered manually into a system used by the fitter, which can be time-consuming and cumbersome, especially in light of the limited time allotted for fitting sessions.

There exists a continuing need for improvement in the field of golf club fitting.

SUMMARY

In accordance with some embodiments of the disclosed subject matter, systems, methods, and media for an electronic tag located on a golf club and containing specifications associated with the golf club which can be transmitted to a detection unit or system, are provided.

In some aspects, a system for golf club fitting includes a golf club, a detection unit, and a smart tag. The golf club has a club head, a shaft, and a grip. The smart tag is configured to communicate with the detection unit when the golf club is positioned within a detection zone associated with a sensor of the detection unit. In addition, the smart tag stores data associated with the golf club, such that the detection unit collects the data associated with the golf club from the smart tag for transmission to a computing device.

In some aspects, a golf club fitting system includes a golf club having a smart tag that stores a unique ID and data associated with the golf club. A detection unit has a sensor that forms a detection zone and a computing device is configured to operate a golf club fitting program. The smart tag is detected when located within the detection zone, and the unique ID and the data associated with the golf club are transmitted to the computing device via the sensor for automatic entry into the golf club fitting program.

In some aspects, a method of using a golf club fitting system includes the steps of providing a golf club having a smart tag, providing a detection unit having a sensor, storing data associated with the golf club in the smart tag, receiving the data associated with the golf club from the smart tag via the sensor, and communicating the data associated with the golf club to a computer.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1:
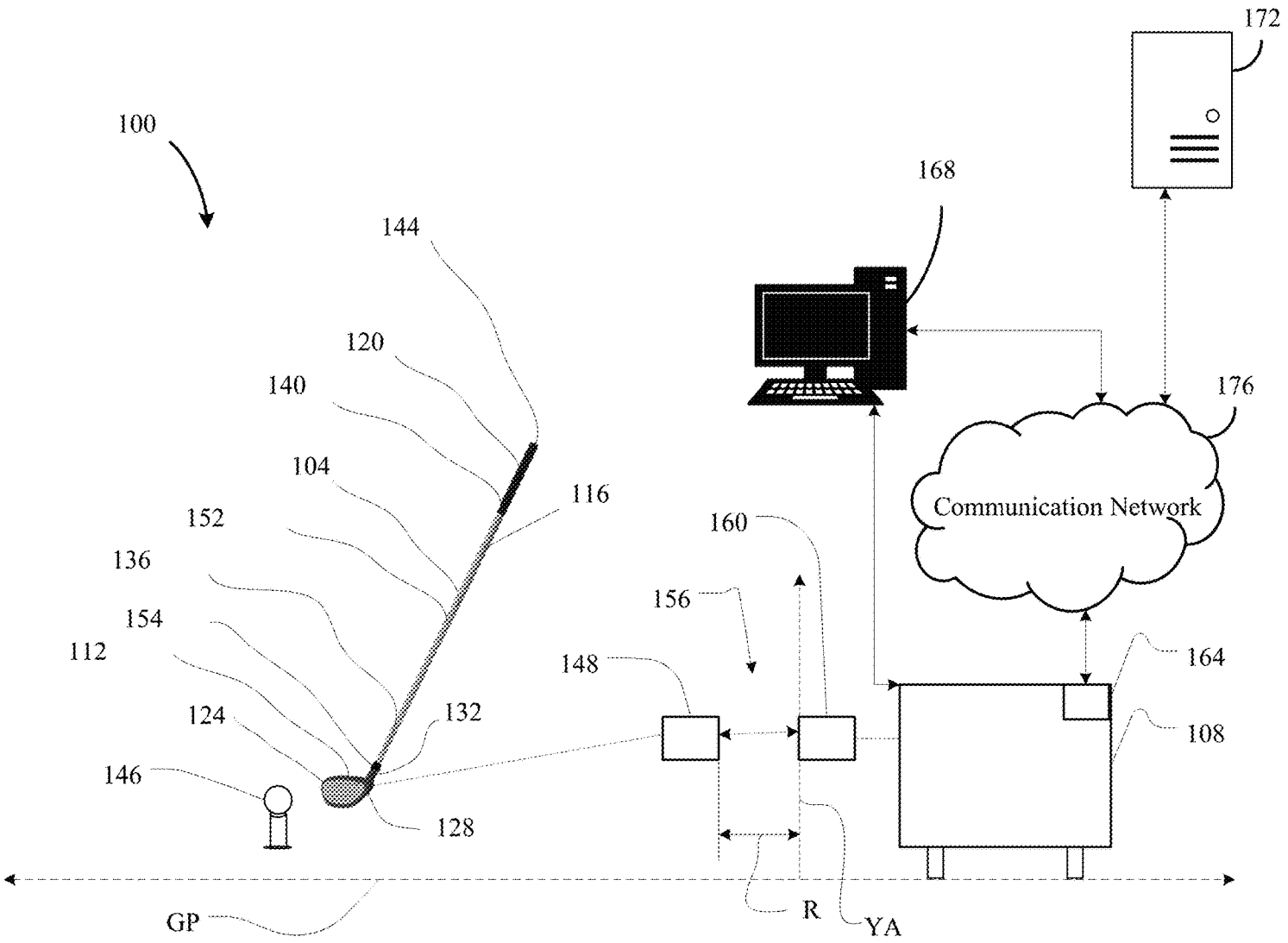
FIG. 1 depicts an example of a system including a golf club having a smart tag and detection unit, in accordance with an embodiment of the disclosed subject matter.
Figure 3:
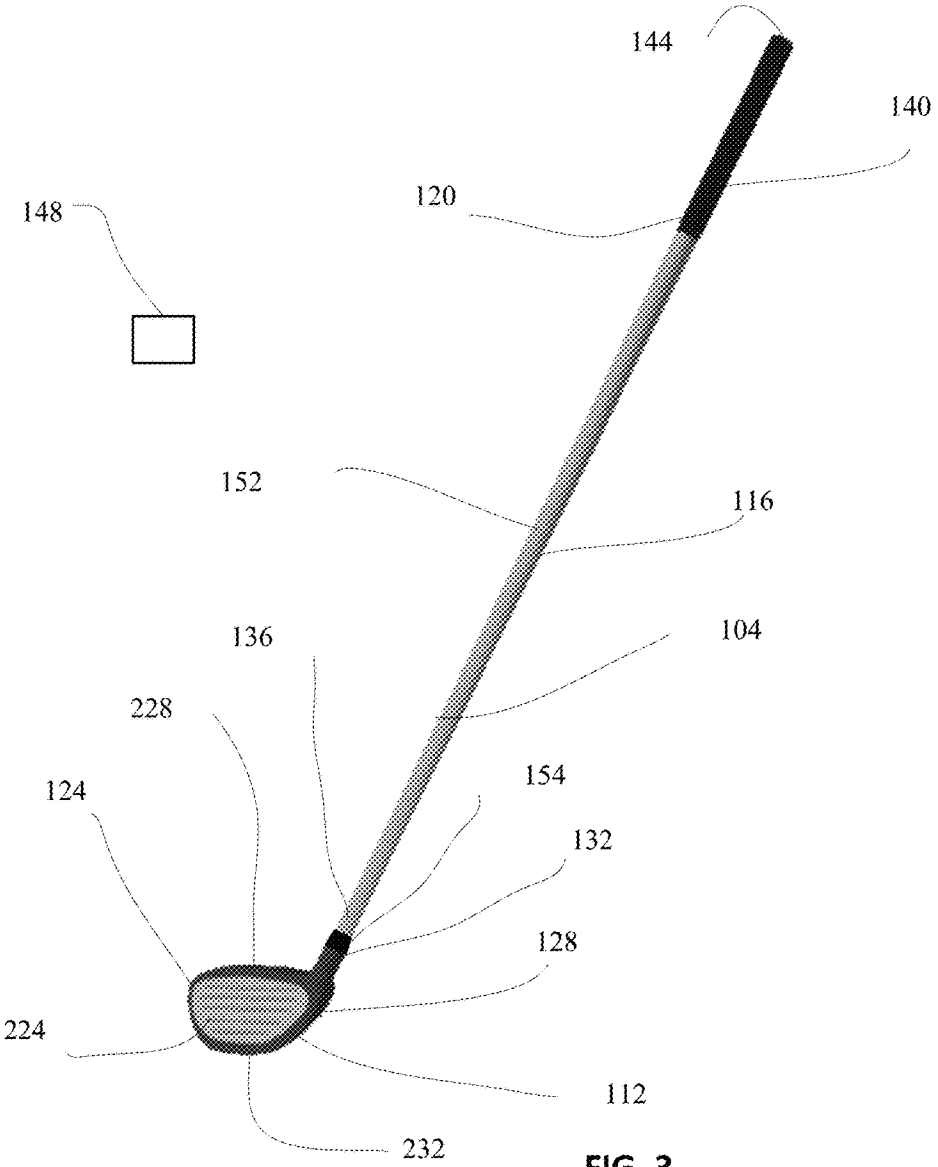
FIG. 3 depicts a schematic representation of the golf club and smart tag of FIG. 1.

FIG. 1 illustrates an example golf club fitting system 100 including a golf club 104 and a detection unit or device 108. As shown in FIG. 1, the golf club 104 includes a club head 112, a shaft 116, and a grip 120. Referring to FIGS. 1 and 3, the golf club head 112 includes a toe end 124 that is opposite a heel end 128 at which a hosel 132 connects to a lower portion 136 of the golf club shaft 116. Further, the grip 120 is disposed at an upper portion 140 of the golf club shaft 116 and covers a butt end or top end 144 of the golf club shaft 116. The detection unit 108 is configured to observe, measure, detect, process, and/or calculate performance data associated with a user swinging the golf club 104 to strike a golf ball 146. In the illustrated embodiment, the detection unit 108 is standing level on a ground plane GP defined by a surface, e.g., artificial or natural ground surface. In some embodiments, the detection unit 108 is raised or elevated relative to the ground plane GP or is disposed at an angle relative to the ground plane GP.

According to embodiments of the present disclosure, a smart tag or chip 148 is located on the golf club 104 and configured to contain data associated with the golf club 104. The smart tag 148 may be located in various positions along the golf club 104, such as in or on the club head 112, the shaft 116, the grip 120, the hosel 132, or some combination thereof. In particular, the smart tag 148 may be located adjacent or at the toe end 124 of the club head 112, the heel end 128 of the club head 112, the hosel 132 of the club head 112, the lower portion 136 of the shaft 116, the grip 120, the upper portion 140 of the shaft 116, or the top end 144 of the shaft 116. In some embodiments, the smart tag 148 may be located adjacent or at a midsection 152 of the shaft 116. In some embodiments, the smart tag is provided as part of a ferrule 154 that is provided adjacent the hosel 132 and the lower portion 136 of the shaft 116. In some embodiments, the smart tag 148 is provided as part of a medallion or badge (not shown).

The smart tag 148 can be any suitable device for storing and transmitting data, such as, e.g., a near field communication (NFC) tag, an RFID tag, or the like. In some embodiments, the smart tag 148 is passive, having no internal power source of its own and, instead, obtains power from the detection unit 108. In some embodiments, the smart tag 148 is powered by an internal power source (not shown), such as, e.g., a battery or a piezoelectric device that is configured to convert kinetic energy into electrical energy. According to embodiments of the present disclosure, the smart tag 148 communicates with other devices, e.g., the detection unit 108, using short-range wireless connections, such as Bluetooth®, RFID, and/or NFC. It is possible that NFC and RFID can work together in a way that an NFC-enabled electronic device reads data from tags having RFID chips, or vice versa. The smart tag 148 and detection unit 108 may be configured to communicate in accordance with various standards and protocols associated with NFC, RFID, or any other short-range or long-range communication methods. For example, the smart tag 148 and detection unit 108 may operate at 13.56 MHz, which is the International Transmission standard for transmission ranges from five to ten centimeters (1.969 inches to 3.937 inches), based on ISO4443 or ISO15693 standards.

Operation between or among the smart tag 148 and detection unit 108 may be of various types or modes, such as, e.g., read/write mode, peer-to-peer mode, or card emulation mode. For example, in peer-to-peer mode, communication between the smart tag 148 and the detection unit 108 can permit an exchange of data, such that both the detection unit 108 and the smart tag 148 send/receive data from one another. In some instances, the smart tag 148 and the detection unit 108 operate in read/write mode so data from the smart tag 148 is read out by the detection unit 108, such as, e.g., through a smart-phone or wearable device or on a display screen or via an audible, visual, or tactile method. In some examples, the smart tag 148 and detection unit 108 operate in card emulation mode so the smart tag 148 can be used to check-in at certain locations, gain access or entry through doors or bays, to initiate or activate a system, e.g., a golf ball dispensing system, to authorize or complete financial transactions, to authenticate a user, or to register a product, e.g., the golf club 104, among other situations. Further, the smart tag 148 may be provided in addition to or in lieu of other sensors or electronic devices carried by the golf club 104, such as, e.g., an Arccos® Caddie Smart Sensor or Smart Grip. For example, using a suitable API, the smart tag 148 may communicate or integrate with the Arccos® sensors or programs.

Still referring to FIG. 1, the detection unit 108 is configured to communicate with the smart tag 148 of the golf club 104 to collect data stored in the smart tag 148. To that end, the detection unit 108 is configured to detect the presence of the smart tag 148 when brought within a pre-determined area or detection zone 156. The detection zone 156 may be proximate or adjacent the detection unit 108, such that the golf club 104 and smart tag 148 thereon are only detected when located proximate or adjacent to the detection unit 108. The detection zone 156 is associated with a sensor 160 of the detection unit 108. In some embodiments, the sensor 160 defines the detection zone 156 with a radius R that sweeps 360 degrees about a reference axis YA defined through, i.e., intersecting, the sensor 160 and extending perpendicular to the ground plane GP. In some embodiments, the sensor 160 is carried by the detection unit 108. In some embodiments, the sensor 160 is contained within the detection unit 108. In some embodiments, the radius R is greater than 0 cm (0 inches) and may extend to about 10 centimeters (about 4 inches) from the axis YA of the sensor 160. Preferably, the smart tag 148 is brought within about 5 centimeters (about 2 inches) of the axis YA of the sensor 160 to ensure near instantaneous communication. In some embodiments, the detection zone 156 is located remotely from the detection unit 108, such that the golf club 104 and smart tag 148 are detected when located remotely from or distanced from the detection unit 108. The sensor 160 defines the detection zone 156 as a volume extending to the extent of the radius R and extending vertically along the axis YA above the ground plane GP. In some instances, the sensor 160 may be adjustable to calibrate the radius R and/or the axis YA of the detection zone 156. For example, the axis YA may be disposed at an angle relative to the ground plane GP during calibration to improve consistency and reliability of detecting the smart tag 148 within the detection zone 156.

The sensor 160 may be any suitable device configured to communicate with the smart tag 148, such as, e.g., a NFC reader, a RFID reader, a camera, a smartphone, or some combination thereof, or the like. The detection unit 108 may further include a transmitter 164, such that the data collected from the smart tag 148 can be transmitted to other devices or systems, such as a computing device 168 or a server 172 of a remote database. The computing device 168 may be provided in the form of a laptop, a desktop, a tablet, a smartphone, a wearable device, a special-purpose computer, or the like. In some instances, the transmitter 164 of the detection unit 108 communicates with the computing device 168 via a communication network 176. In some embodiments, the detection unit 108 may be portable and configured to communicate with the computing device 168 via a Wi-Fi network, e.g., WLAN or WAP, cellular data, Bluetooth®, or any suitable wireless communication method, so as to permit operation outdoors on a golf course or at a driving range. In some instances, the computing device 168 is hardwired, e.g., via an Ethernet cable or USB cable or the like, to the detection unit 108, such as to the transmitter 164 thereof.

The smart tag 148 can store data associated with the golf club 104 for communication with the detection unit 108 at various times or in accordance with various conditions. For example, when a user or golf club fitting professional selects the golf club 104 from available inventory during a fitting session, data associated with the golf club 104, such as the type, brand, model, and settings, among other information, are manually entered by the user or fitting professional into the computing device 168 running a golf club fitting software application or club fitting program. According to embodiments of the present disclosure, the smart tag 148 of the golf club 104 may store the data associated with the golf club 104 and, when detected by the detection unit 108, the data may be wirelessly transmitted to the detection unit 108 and/or to the computing device 168 or server 172 running the fitting program. It will be appreciated that an application programming interface (API) can be used to allow the detection unit 108 to interface with the computing device 168 and/or the club fitting software program operated thereon. In some embodiments, when the smart tag 148 is placed in proximity to the sensor 160 of the detection unit 108, e.g., in the detection zone 156, the data associated with the golf club 104 is read and automatically entered into the computing device 168 or a club fitting software program operated on the computing device 168 or server 172. In this way, entry of the data associated with the golf club 104 is performed more quickly and more efficiently as compared to traditional manual entry, which saves time and reduces the potential for human error, among other benefits. In some embodiments, the detection unit 108 may be part of a fitting or performance tracking system, such as, e.g., TrackMan®, GCQuad®, FlightScope®, SkyTrak®, TopTracer®, GCHawk®, or the like. Accordingly, the detection unit 108 may carry a plurality of sensors (not shown), including a camera, a photodiode, complementary metal-oxide-semiconductor (CMOS), an infrared sensor, a proximity sensor, a motion sensor, LiDAR sensor, RADAR sensor, or the like.

In some instances, the smart tag 148 and sensor 160 are retrofitted to existing fitting or performance tracking systems. To that end, the smart tag 148 and sensor 160 can be provided as a kit or package for use with a variety of golf clubs, fitting or performance tracking systems, computing devices, and in various locations and environments. As mentioned above, it will be appreciated that an application programming interface (API) can be used to allow the detection unit 108 to interface with the computing device 168 and/or the club fitting software program operated thereon. Further, it is contemplated that the smart tag 148 and sensor 160 may be provided as part of a kit or package including additional accessories and tools, such as, e.g., an adjustable hosel assembly or adaptor, a weight assembly, a grip, articles of apparel, gloves, eyewear, wearable devices, and the like. For example, the smart tag 148 may be located in or on the ferrule 154 prior to assembling the ferrule 154 with the golf club 104. In some instances, the ferrule 154 and the smart tag 148 are removable and replaceable for use with multiple golf clubs, shafts, grips, hosels, and/or club heads. In some embodiments, the golf club 104 is modular and includes modular components, such that the club head 112, the shaft 116, the grip 120, the hosel 132, the ferrule 154, and/or a weight insert or component are all capable of being disassembled and/or detached and replaced. When the smart tag 148 is provided as part of a modular component, the data stored on the smart tag 148 can be updated or edited via an API or program in connection with the computing device 168, the server 172, and/or the detection unit 108 to reflect the configuration of the modular golf club 104.

In some embodiments, data associated with the entire golf club head 112 is stored in the smart tag 148. In some embodiments, only data associated with shaft 116 is stored in the smart tag 148. In some embodiments, only data associated with the grip 120 is stored in the smart tag 148. In some embodiments, one smart tag 148 stores data associated with the entire golf club 104, including the club head 112, shaft 116, and grip 120. In some embodiments, multiple tags 148 are provided on the golf club 104 and each corresponds to different aspects thereof, such as one smart tag 148 being dedicated to storing data associated with the golf club head 112 and another smart tag 148 being dedicated to storing data associated with the shaft 116 and/or grip 120. Accordingly, the smart tag 148 may comprise a plurality or network of tags.

According to embodiments of the present disclosure, the smart tag 148 stores, or can be edited to store, data associated with the golf club 104, or components thereof. Accordingly, the data associated with the golf club 104 can include club type, club brand, club model or edition, shaft type, shaft brand, shaft model or edition, shaft length, shaft stiffness, shaft material, shaft shape, shaft color, grip type, grip brand, grip model or edition, grip thickness, grip length, grip size, grip thickness, grip material, grip color, hosel type, hosel brand, hosel model or edition, hosel length, hosel material, hosel size, hosel assembly adjustment or settings, hosel color, ferrule type, ferrule brand, ferrule model or edition, ferrule size, ferrule material, ferrule color, weight type, weight brand, weight model or edition, weight size, weight mass, weight attachment type, weight location or settings, club head type, club head color, club head loft angle, club head lie angle, club head weight, club head size, club head volume, club head shape, club head material, club head sole bounce, club head sole design, club head sole width, club head crown design, club head center of gravity location, club head product of inertia values, club head coefficient of restitution, club head face angle, club head face thickness, club head face size, club head face design, club head offset, club head topline thickness, club head blade length, club head scoreline length, club head scoreline spacing, club head blade profile shape, club head leading edge type, club head par area length, club head groove type, club head groove design, club head coefficient of resistance, club head impact point location, club head impact sound, club head impact feel, club head filler material, club head filler density, club head finish type, club head insignia, club head medallion design, or number of clubs of a golf club set, or combinations thereof.

It is contemplated that the smart tag 148 is writeable and can be edited throughout its useable lifecycle. It is contemplated that the smart tag 148 may store identification, e.g., a unique product identifier (UPID) or a barcode or a serial number or a hash, or locating information, e.g., a uniform resource locator (URL), that points to a remote database in which data associated with the golf club 104 is stored and maintained. It is contemplated that the smart tag 148 may be provided in the form of a computer-readable marking or code that can be applied or printed on the golf club 104. It is contemplated that the smart tag 148 is provided with the golf club 104 as a single, unitary package, such that inclusion of the smart tag 148 with the golf club 104 occurs during manufacturing and before complete assembly of the golf club 104. In some instances, the smart tag 148 can be attached or connected to the golf club 104 in post-manufacturing stages, such that the smart tag 148 can be selectively arranged or located on various golf clubs, as part of modular components of golf clubs, or other articles of manufacture.

In some instances, the smart tag 148 is capable of automatically transmitting stored data associated with the golf club 104 to the detection unit 108. To that end, once the smart tag 148 is brought into the detection zone 156, the sensor 160 detects the smart tag 148 and data is transferred to the detection unit 108 without requiring any further action or step performed by a user or fitting professional. In some instances, the smart tag 148 may prompt a user or fitting professional to approve or authenticate before permitting transfer of the data associated with the golf club 104 to the detection unit 108. For example, a user or fitting professional may receive a prompt, e.g., push data on a smartphone, from the detection unit 108, or from the system 100 in connection with the detection unit 108, or from a web-based application in connection with the detection unit 108. In some instances, the push data may require the user or fitting professional to authenticate by way of, e.g., face identification, voice identification, entering login credentials, receiving a temporary code via text or phone call and entering the code into an application, or locating the smartphone near a smart tag 148 or detection unit 108 for additional detection thereof.

It is contemplated that the detection unit 108 permits performance data to be tracked and stored within a remote database in connection with a user profile linked to the user associated with the smart tag 148. To that end, the smart tag 148 may include a user identification number (UIN) or other code for identifying the user associated with the golf club 104. The smart tag 148, in this instance, may store a uniform resource identifier or locator (URI or URL) for accessing the remote database in which the user profile or account is stored and maintained. Performance data can include club speed, attack angle, dynamic loft, club path, face angle, face to path, spin loft, swing plane, swing direction, low point, impact height, impact offset, dynamic lie, ball speed, launch angle, spin rate, launch direction, spin axis, height, curve, landing angle, and carry.

Figure 2:
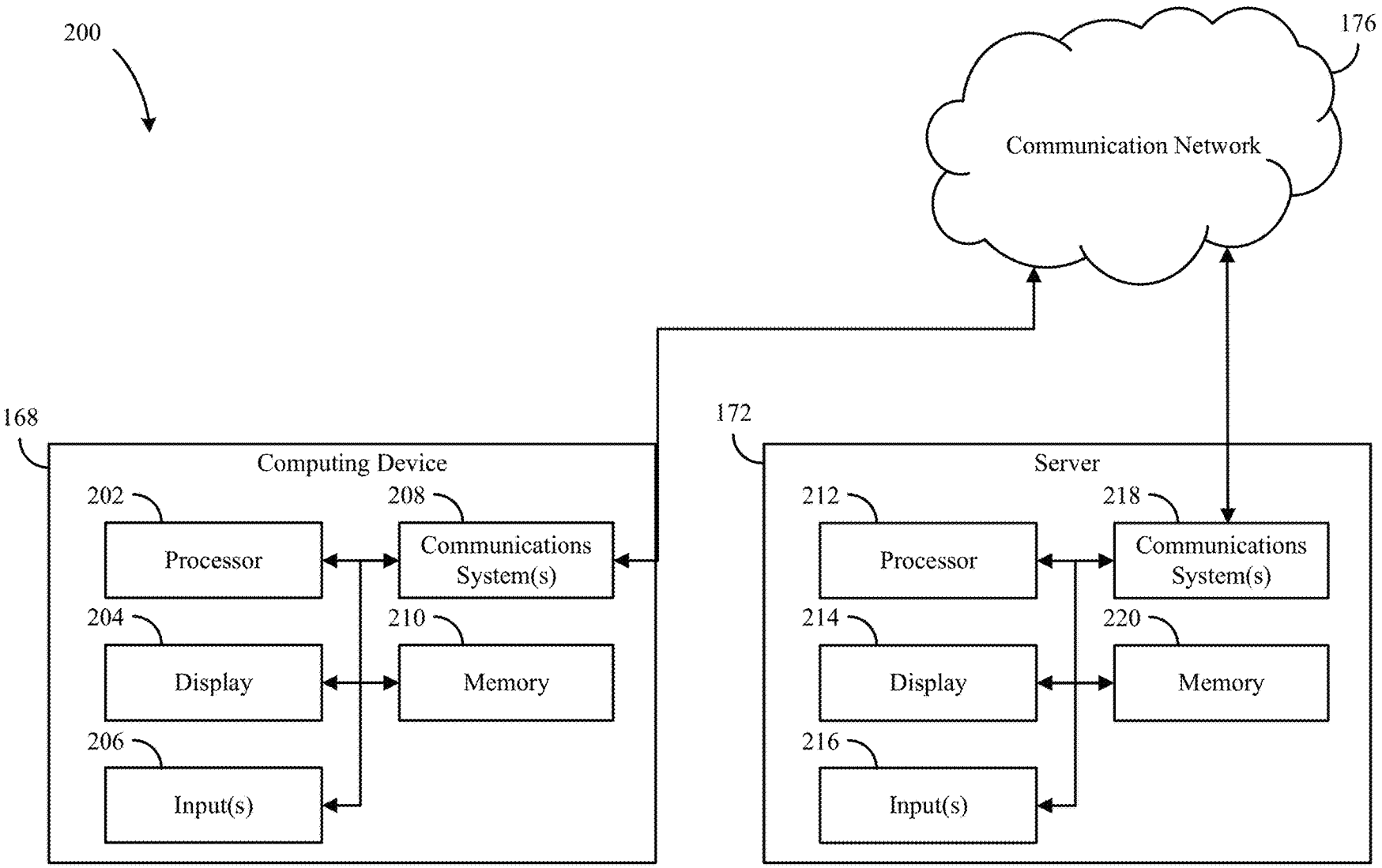
FIG. 2 depicts an example communication architecture for the system of FIG. 1.

Further, the detection unit 108, upon detecting the smart tag 148, may access the user profile or account via the URI or URL provided by the smart tag 148. In addition, the detection unit 108 may retrieve data associated with the user and/or the golf club 104 only after the user authorizes such activity via a prompt, e.g., a push notification or text message or other communication. FIG. 2 shows an example of architecture 200 that can be used to implement computing device 168 and/or server 172 in accordance with some embodiments of the disclosed subject matter. As shown in FIG. 2, in some embodiments, computing device 168 can include a processor 202, a display 204, one or more inputs 206, one or more communication systems 208, and/or memory 210. In some embodiments, processor 202 can be any suitable hardware processor or combination of processors, such as a central processing unit (CPU), a graphics processing unit (GPU), an application specific integrated circuit (ASIC), a field-programmable gate array (FPGA), etc. In some embodiments, display 204 can include any suitable display device, such as a computer monitor, a touchscreen, a television, etc. In some embodiments, inputs 206 can include any suitable input devices and/or sensors that can be used to receive user input, such as a keyboard, a mouse, a touchscreen, a microphone, a camera, etc.

In some embodiments, the communication system 208 can include any suitable hardware, firmware, and/or software for communicating information over communication network 176 and/or any other suitable communication networks. For example, the communication system 208 can include one or more transceivers, one or more communication chips and/or chip sets, etc. In a more particular example, the communication system 208 can include hardware, firmware and/or software that can be used to establish a Wi-Fi connection, e.g., WLAN or WAP, a Bluetooth® connection, a cellular connection, an Ethernet connection, etc.

In some embodiments, memory 210 can include any suitable storage device or devices that can be used to store instructions, values, data, etc., that can be used, for example, by processor 202 to generate a virtual object or graphical user interface (GUI) for the display 204, to communicate with server 172 via communication system 208, etc. Memory 210 can include any suitable volatile memory, non-volatile memory, storage, or any suitable combination thereof. For example, memory 210 can include random access memory (RAM), read-only memory (ROM), electronically-erasable programmable read-only memory (EEPROM), one or more flash drives, one or more hard disks, one or more solid state drives, one or more optical drives, etc. In some embodiments, memory 210 can have encoded thereon a computer program for controlling operation of computing device 168. For example, the processor 202 can execute at least a portion of the computer program to implement the system 100 for collecting, storing, transmitting, and/or updating data of the smart tag 148 of the golf club 104. In another example, in such embodiments, processor 202 can execute at least a portion of the computer program to receive data from the smart tag 148 via the detection unit 108, store the data in memory, convey the data to a user profile in a database storing user information, generate a non-fungible token based on the data, and mint the non-fungible token to a blockchain network made up of computing devices 168 and/or servers 172. As yet another example, processor 202 can execute at least a portion of process P100 described below in connection with FIG. 6.

In some embodiments, server 172 can include a processor 212, a display 214, one or more inputs 216, one or more communications systems 218, and/or memory 220. In some embodiments, processor 212 can be any suitable hardware processor or combination of processors, such as a CPU, a GPU, an ASIC, an FPGA, etc. In some embodiments, the display 214 can include any suitable display device, such as a computer monitor, a touchscreen, a television, etc. In some embodiments, inputs 216 can include any suitable input devices and/or sensors that can be used to receive user input, such as a keyboard, a mouse, a touchscreen, a microphone, a camera, etc.

In some embodiments, communications systems 218 can include any suitable hardware, firmware, and/or software for communicating information over communication network 130 and/or any other suitable communication networks. For example, communications systems 218 can include one or more transceivers, one or more communication chips and/or chip sets, etc. In a more particular example, communications systems 218 can include hardware, firmware and/or software that can be used to establish a Wi-Fi connection, e.g., WLAN or WAP, a Bluetooth® connection, a cellular connection, an Ethernet connection, etc.

In some embodiments, memory 220 can include any suitable storage device or devices that can be used to store instructions, values, data, etc., that can be used, for example, by processor 212 to present content using display 214, to communicate with one or more computing devices 168, etc. Memory 220 can include any suitable volatile memory, non-volatile memory, storage, or any suitable combination thereof. For example, memory 220 can include RAM, ROM, EEPROM, one or more flash drives, one or more hard disks, one or more solid state drives, one or more optical drives, etc. In some embodiments, memory 220 can have encoded thereon a server program for controlling operation of server 172.

Referring to FIG. 3, the club head 112 of the golf club 104 includes a face 224 extending between the toe end 124 and the heel end 128 and between a top or crown 228 and a bottom or sole 232. In some embodiments, the smart tag 148 may be located along the top or crown 228 of the club head 112. In some embodiments, the smart tag 148 is located along the bottom or sole 232 of the club head 112. In some embodiments, the smart tag 148 is suspended or provided within the club head 112 between the top 228 and bottom 232, or between the heel end 128 and the toe end 124. In some embodiments, the smart tag 148 is provided along the face 224.

Figure 4:
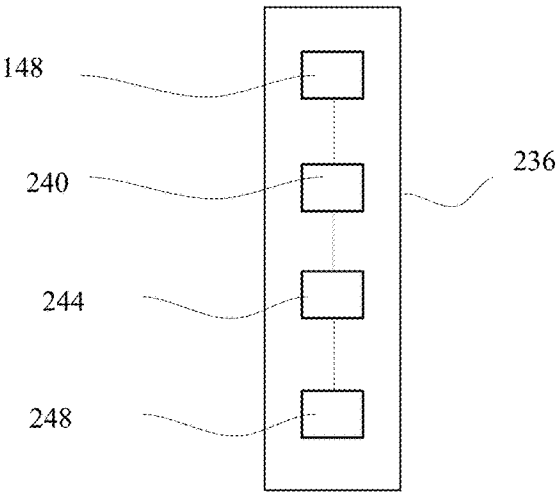
FIG. 4 depicts a schematic representation of a housing for the smart tag of FIG. 1.

Referring to FIG. 4, a schematic representation of the smart tag 148 illustrates an embodiment in which the smart tag 148 includes a housing 236. The housing 236 may be integrally formed with the golf club 104, such as during manufacture. The housing 236 may be separate and distinct from the golf club 104, such that the housing 236 is coupled or attached to the golf club 104 using any suitable technique, such as, e.g., fastening, adhering, welding, molding, or the like. For example, the housing 236 may include protruding posts (not shown) that carry threaded portions, or rivets, or barbs for securely fastening the housing 236 to the golf club 104. In some instances, the housing 236 is a weight member (not shown) that is removably fastened to the club head 112 of the golf club 104. In some embodiments, the housing 236 is an endcap that is configured to attach to the butt end 144 of the shaft 116 and/or grip 120. The housing 236 may be provided as a hollow enclosure in which the smart tag 148 is disposed. The housing 236 may be provided as a solid component that is formed around the smart tag 148, such as during a molding process. The housing 236 is depicted as having a rectangular shape, although other shapes are contemplated, including triangular, cylindrical, conical, spherical, or any regular polygonal shape, or any irregular shape, or combinations thereof. Further, the housing 236 may be provided as a single, unitary component. In some instances, the housing 236 includes multiple components or segments coupled or assembled together.

Still referring to FIG. 4, the smart tag 148 and housing 236 may be provided with a power source 240 for storing and conveying power to the smart tag 148. In some instances, the power source 240 is housed within the housing 236. In some instances, the power source 240 is integrally formed with the housing 236. The power source 240 may be provided in the form of a battery, a capacitor, a piezoelectric transducer, or the like. Further, a module 244 may be provided in connection with the housing 236 and the smart tag 148, and also with the power source 240. The module 244 may be a controller or microprocessor, a backup memory unit, a transceiver, an indicator, e.g., a LED or bulb, a connector, e.g., a 2-pin or 3-pin connector, or a USB or HDMI or Ethernet port. Additionally or alternatively, an alternate smart tag or second smart tag 248 may be provided in connection with the smart tag 148 and/or the housing 236, as well as the power source 240 and/or the module 244. The alternate tag 248 may function identically to the smart tag 148, such that redundancy is provided in the event one of the tags 148, 248 is damaged or stolen. In that instance, both tags 148, 248 may operate as NFC tags, or RFID tags, or Bluetooth® units, or the like. The alternate tag 248 may function differently from the smart tag 148. For example, the smart tag 148 may operate using NFC connections while the alternate tag 248 may operate using RFID connections, or vice versa. The alternate tag 248 may be located apart from the smart tag 148, e.g., in a different position of the golf club 104. For example, the smart tag 148 may be located on the club head 112 and have data associated with aspects of the club head 112, while the alternate tag 248 may be located on the grip 120 and have data associated with the grip 120. It is contemplated that the smart tag 148 and the alternate tag 248 may be provided on/in the golf club 104 at different times, such as before and after manufacturing.

Figure 5:
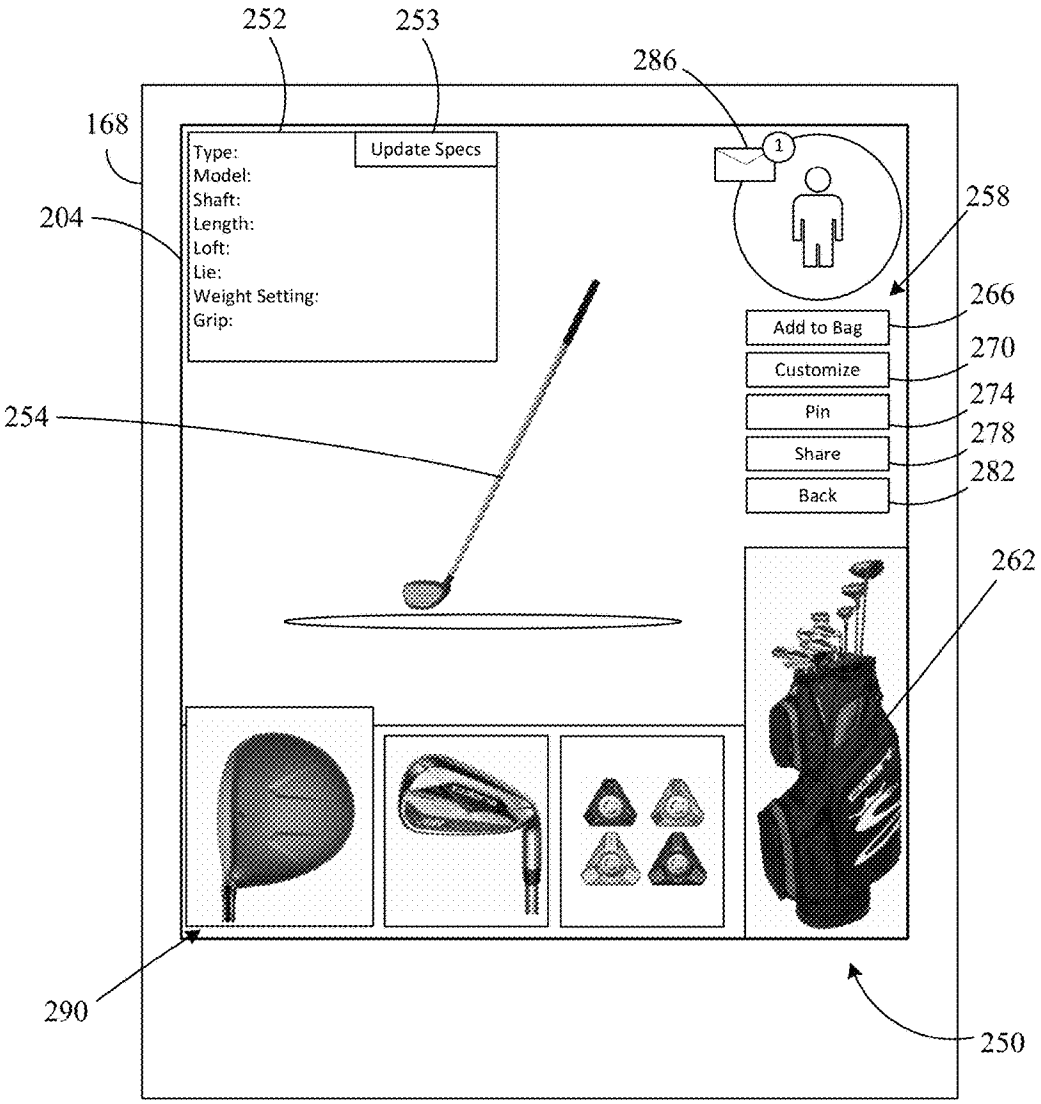
FIG. 5 depicts an example graphical user interface for the system of FIG. 1.

Referring to FIG. 5, a graphical user interface (GUI) 250 is provided on the display 204 of the computing device 168 for interfacing with system 100, the detection unit 108, the smart tag 148, and/or the golf club 104. In some instances, the GUI 250 is accessible as a web-based program or application, a mobile application, a desktop or localized application, or the like. The GUI 250 may include an information panel 252 that displays the data associated with the golf club 104 which was stored on the smart tag 148. In some embodiments, the information panel 252 only displays a portion of the data at one time, such that scrolling or toggling is required to observe other portions of the data. In some examples the GUI 250 includes a visual object 254 in the form of a rendering, CAD model, image, or symbol representing the golf club 104 and the data in the information panel 252, or aspects thereof. In some embodiments, the information panel 252 of the GUI 250 has a button 253 for Updating Specs to allow a user or golf club fitting professional to adjust, edit, or change aspects of the data presented in the information panel 252. In some instances, the visual object 254 is mutable and can be edited, customized, altered, or even combined with secondary or tertiary visual objects or graphics by way of the button 253 of the GUI 250. In some instances, the GUI 250 is accessible only after entering certain login credentials to authorize the user. In such instances, the GUI 250 may display a profile picture, avatar, or digital representation of the user. In some instances, the GUI 250 displays non-registered user information, such that no login credentials are required.

As illustrated in FIG. 5, the GUI 250 may include a menu of selectable options 258 that are conditionally presented to a user based on certain information or inputs. For example, the GUI 250 may include a user profile in which a user has a virtual golf bag or fitting cart 262 comprising various virtual golf clubs, which may correspond to physical golf clubs that the user has purchased or used. During or after use of the golf club 104, the user may be presented with a first option 266 to Add to Bag, such that data associated with the golf club 104 may be stored and accessible to the user at a later time. In some instances, the Add to Bag function of the first option 266 may allow the user to purchase the golf club 104, or a similar club in inventory.

In some instances, the menu of selectable options 258 can include a second option 270 to Customize that, if chosen, can take the user to a suite in which various parameters and/or aspects of the golf club 104 can be adjusted or replaced. It is contemplated that the user may customize the golf club 104 in accordance with data collected and analyzed as part of a fitting session, or a practice round, or with personalized decorations or indicia, or based on adjustments made by golfers of similar size, weight, swing speed, location, experience level or handicap, among others. It is contemplated that the user may customize the golf club 104 according to one or more packages, such as a Limited Edition package in which two or more golf clubs are personalized with certain finishes, indicia, sensors or tags, shaft lengths, shaft stiffnesses, grips, loft, lie, weights, or any other adjustments. In some instances, the menu of selectable options 258 includes a third option 274 to Pin that provides the user with a bookmarking feature for quickly returning to the particular golf club 104 or product.

The menu of selectable options 258 can include a fourth option 278 to Share for publishing a notification via one or more social medial websites or applications, or for directly emailing or messaging another golfer about the golf club 104. The menu of selectable options 258 may include a fifth option 282 as a Back button to return to a previous screen, or a previous product or golf club, or a previous setting, or the like. The GUI 250 may include a messaging module 286 for communicating with a fitting professional, for receiving product and brand updates, or for interfacing with the smart tag 148 and/or detection unit 108, among other functions. The user profile may include a menu of various related products 290, such as products manufactured or offered by a certain brand. The GUI 250 may run or interface with an algorithm that provides recommendations to the user based on a history of data collected from the user's purchases, performance, locations, etc. In some instances, the GUI 250 is operable to authenticate or approve communication between the smart tag 148 and detection unit 108. For example, the GUI 250 may require access and verification of a user's location before permitting the smart tag 148 to transmit data to the detection unit 108. In some instances, the GUI 250 may permit the user to modify the data associated with the golf club 104, such as when modifications or updates have been performed to the golf club 104. In some instances, the GUI 250 may permit the user to hide data associated with the golf club 104, such as purchase history or identification information or any other aspects the user desires to remain stored on the smart tag 148 but not transmitted to the detection unit 108.

In some instances, the GUI 250 generates or displays a notification when an unrecognized detection unit attempts to communicate with the smart tag 148 of the golf club 104. Accordingly, the smart tag 148 may be used to identify and retrieve the lost, missing, or stolen golf club 104, or component, including the smart tag 148 by providing the user or owner, e.g., fitting professional or company, notifications about when and where such unauthorized attempts are made. For example, unauthorized attempts may be indicated via messaging module 286 or push data. The UPID, IP address, or identifiers of the smart tag 148, the detection unit 108, and the computing device 168 are recorded in the remote database when those devices are registered or purchased. The unauthorized attempts may be identified by the smart tag 148 being detected or activated by an unrecognized or unregistered IP address, or beyond a predetermined distance or range from the authorized or registered computing device 168 or detection unit 108. For example, the smart tag 148 may store a URL that, upon detection, accesses a website via the unauthorized reader or detector's network connection. When the website is accessed, the time, date, IP address or other identifier, and/or location are recorded in a remote data base, e.g., the server 172, which prompts a notification to be sent to the registered or authorized user or entity via the GUI 250.

It will be appreciated that the smart tag 148, the detection unit 108, and/or the computing device 168 may implement symmetric or asymmetric encoding algorithms or methods, such as, e.g., advanced Encryption Standard (AES), Rivest-Shamir-Adleman (RSA), Triple Date Encryption Standard (DES), Twofish, or any other suitable encryption method. In some instances, the smart tag 148 may be compatible with hashing functions or algorithms implemented by the device computing device 168 or detection unit 108, such as, e.g., Secure Hash Algorithms (SHA) published by the National Institute of Standards and Technology (NIST), or equivalents.

Figure 6:
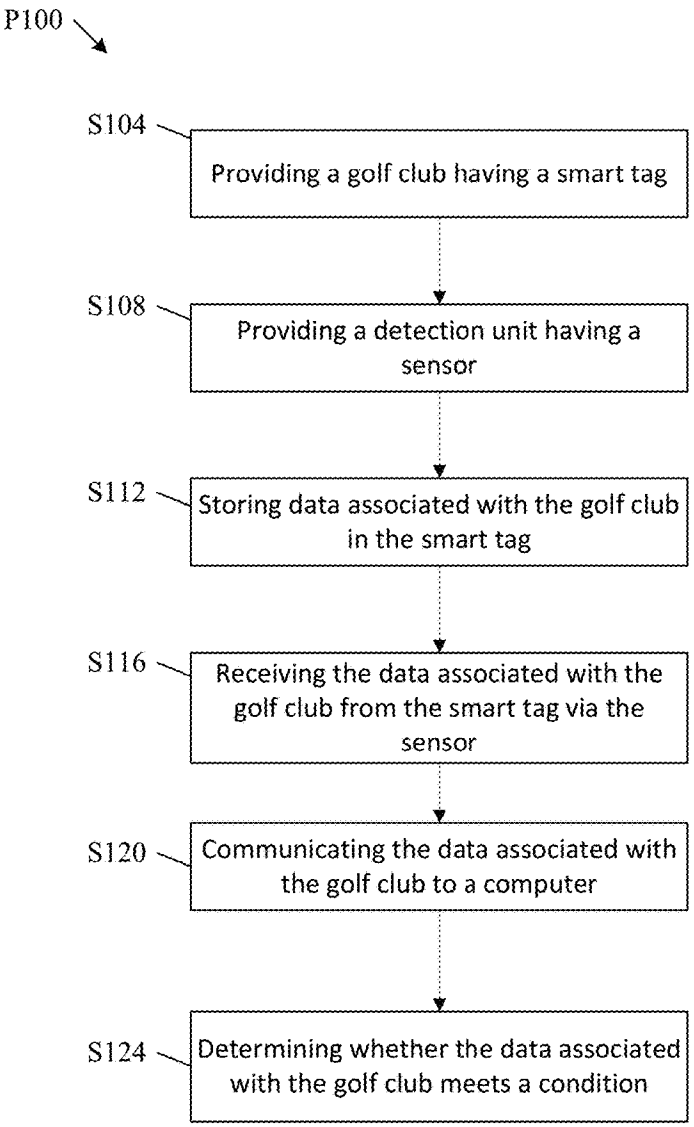
FIG. 6 depicts an example process of using the system of FIG. 1.

FIG. 6 depicts an example process P100 for using the system 100. In Step S104, the smart tag 148 and the golf club 104 are provided, such as being integrally formed during manufacturing, or attached during manufacturing, or attached post-manufacturing. In Step S108 the detection unit 108 is provided with the sensor 160. In Step S112, the data associated with the golf club 104 and/or user is stored on the smart tag 148, e.g., written, programmed, downloaded, or entered. It will be appreciated that Step S112 may be performed by a manufacturer of the golf club 104, or a fitting professional, or a user. For example, a UPID or other identifier of the golf club 104 may be written to the smart tag 148 as part of the manufacturing process. In some instances, a UPID is provide for each of the components of the golf club 104, including the club head 112, the shaft 116, and the grip 120, which may be additional to an overall UPID for the assembled golf club 104. It will further be appreciated that the smart tag 148 may be loaded with stock or default data associated generically with the golf club 104, and data may be modified or added to the smart tag 148 upon final finishing, customization, transactions, or other events associated with the golf club 104 and/or user.

In Step S116, the smart tag 148 is positioned adjacent or proximate the sensor 160 of the detection unit 108. Step S116 may be referred to as "tapping" or "bumping" the smart tag 148 and/or the golf club 104 with the detection unit 108, although physical contact therebetween is not required. As a result of such tapping in Step S116, the data associated with the golf club 104 and/or user is transmitted wirelessly, e.g., over Wi-Fi or Bluetooth® or any other wireless communication method, to the detection unit 108. As described above, the detection unit 108 may simply retrieve a URI or URL from the smart tag 148 which allows the detection unit 108 to access a remote database in which the specifications of the golf club 104 and/or user information are available. In step S120, the detection unit 108 communicates the data associated with the golf club 104, which was collected from the smart tag 148, to the computing device 168 and/or server 172. It will be appreciated that the data collected from the smart tag 148 may be displayed by the computing device 168 via the display 204, which may be provided in connection with the GUI 250.

Further, in Step S124, a club fitting software program or the fitting professional or user determines whether the data collected from the smart tag 148 meets a condition, e.g., accuracy, completeness, or preferences. It will be appreciated that depending on the determination of S124, the data may be modified or adjusted, such as via the button 253 in the GUI 250. Further, subsequent to the collection of data from the smart tag 148, as described in the process P100, the system 100 detects and/or records information associated with usage of the golf club 104 or performance of the user. In some instances, the usage or performance data may be collected via the detection unit 108, analyzed via the computing device 168, and stored within a remote database for use within an algorithm that feeds the GUI 250.

In this way, the entry of specifications and other data associated with the golf club 104 and/or user can be transmitted to the detection unit 108 wirelessly and without requiring human input or data entry. Accordingly, the system 100 and process P100 saves time and reduces the potential for inaccuracies or discrepancies caused by human error. The smart tag 148, detection unit 108, and process P100 may be used in a variety of applications, such as, e.g., a driving range, an indoor golf simulator, a golf course, or at a residence. For examples, smart tags 148 may be provided on the golf clubs that serve as rental or loaner inventory at a driving range that has a detection unit, such as the detection unit 108. In this way, usage of the golf clubs by golfers can be recorded and tracked via the smart tag 148. Further, some driving range systems capture ball data and shot data to provide golfers the ability to compete with one another or with themselves, whether in-person or virtually, and the use of smart tags 148 on the golf club may permit the driving range systems to include data associated with the golf clubs to enhance the experience of such systems, while also providing additional data to the driving range.

The above-described aspects of the process P100 of FIG. 6 can be executed or performed in any order or sequence not limited to the order and sequence shown and described in the figures. Also, some of the above aspects of the process P100 of FIG. 6 can be executed or performed substantially simultaneously where appropriate or in parallel to reduce latency and processing times.

According to embodiments of the present disclosure, smart tag 148, alternate tag 248, housing 236, and/or components thereof may be concealed or housed within the golf club 104, or components thereof, before or during manufacturing. For example, the smart tag 148 may be installed or mounted within the club head 112 via an adhesive, a fastener, molding techniques, or additive manufacturing methods. In some embodiments, the smart tag 148 is installed or mounted to the golf club 104, or components thereof, after manufacturing is complete, which may also be accomplished via an adhesive, a fastener, molding techniques, or additive manufacturing methods. In some embodiments, the golf club 104, or components thereof, are additively manufactured, or 3-D printed, using any suitable technique. In some embodiments, the golf club 104, or components thereof, may be manufactured using subtractive techniques, such as casting, forging, molding, milling, e.g., CNC, coldworking, extruding and cutting, or the like.

It will be appreciated that the additive manufacturing techniques used are dependent, at least in part, on the materials involved. For example, when metal materials are involved, metal additive manufacturing methods are suitable, such as, e.g., fused-deposition modeling (FDM), binder jetting (BJ), nanoparticle jetting (NPJ), or other processes involving sintering. Additionally or alternatively, additive manufacturing processes involving melting may be used, such as laser powder bed fusion (LB-PBF), electron beam powder bed fusion (EB-PBF), direct metal deposition, e.g., using laser or electron beams, plasma or arc welding, or the like. Further, when non-metal materials like polymers are involved, other additive manufacturing methods may be used, which may be similar in name to the metal processes but modified for use with non-metals. For example, additive manufacturing methods for composites may include BJ, direct energy deposition (DED), selective laser melting (SLM), FDM or fused filament fabrication (FFF), electron beam melting (EBM), LB-PBF, ultrasonic additive manufacturing (UAM), material extrusion, material jetting, Joule printing, electrochemical deposition, cold spray metal printing, LENS laser-based printing, vat photopolymerization, sheet lamination, electron beam freeform fabrication (EBF3), digital light processing (DLP), or digital composite manufacturing (DCM), among others. It is contemplated that fiber strands, whether cut, chopped, or continuous, may be incorporated into a composite part using various additive manufacturing methods, including continuous fiber fabrication (CFF), among others, to provide selectively reinforced and strengthened components. Because additive manufacturing involves the addition of material in an iterative process to construct a component as designed, waste of material and time is minimized. This is particularly important when considering costs associated with expensive materials like carbon fiber and Kevlar®, and also when considering the availability of supplies and/or shipping of such materials on an as-needed basis. By reducing waste, users can source materials in more accurate quantities and with greater predictability, while also saving on shipping costs and resulting emissions and/or pollution associated with the shipping and transport of expensive materials over long distances, e.g., globally. In some instances, further treatment is required, such as, e.g., compression molding, polishing, sanding, heat treating or annealing, coldworking, welding, fastening, adhering, or bonding, among others.

The system 100 of the present disclosure may be used in connection with the systems and methods disclosed in U.S. application Ser. No. 17/747,226, U.S. application Ser. No. 17/885,878, U.S. application Ser. No. 17/891,481, and U.S. application Ser. No. 17/964,656, each of which is incorporated by reference herein in its entirety. For example, the system 100 may be configured to generate non-fungible tokens (NFT) for which a private key or address is stored in the smart tag 148 to provide authentication of the data associated with the golf club 104, as well as to connect the physical golf club with the virtual representation thereof for use in virtual environments.

Further, it is contemplated that the smart tag 148 may be located on the golf ball 146 and the detection unit 108 may be arranged to locate the detection zone 156 on at least part of a golf course, such as on the green or near a water hazard or in the rough. In this way, the smart tag 148 and detection unit 108 may be used to track and identify data associated with the ball, such as the ball type, ball brand, ball color, ball model or edition, shot distance, ball location, and the user associated with the ball. Similarly, the smart tag 148 and detection unit 108 may be applicable to other sports or applications beyond golf. For example, the smart tag 148 may be provided on articles of apparel, accessories, or footwear, among other articles of manufacture.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A system for golf club fitting, comprising:

a golf club having a club head, a shaft, and a grip;

a detection unit standing on a ground plane; and a smart tag, wherein the smart tag is configured to communicate with the detection unit when the golf club is positioned within a detection zone associated with a sensor of the detection unit, and wherein the smart tag stores data associated with the golf club, such that the detection unit collects the data associated with the golf club from the smart tag for transmission to a computing device, wherein the sensor defines the detection zone as a volume extending to an extent of a radius R about a reference axis that is perpendicular to the ground plane and extending vertically along the reference axis above the ground plane.

2. The system of claim 1, wherein the sensor is carried by the detection unit and the detection zone is located adjacent the detection unit.

3. The system of claim 1, wherein the sensor and the detection zone are distanced from the detection unit.

4. The system of claim 1, wherein the smart tag is located along the club head of the golf club.

5. The system of claim 1, wherein the smart tag is located along the shaft of the golf club.

6. The system of claim 1, wherein the smart tag is located along the grip of the golf club.

7. The system of claim 1, wherein the smart tag is provided as part of a ferrule on the shaft of the golf club.

8. The system of claim 1, wherein the smart tag is provided as part of a hosel or hosel adaptor of the golf club.

9. The system of claim 1, wherein the smart tag is at least one of an NFC tag or a RFID tag.

10. A golf club fitting system, comprising:

a golf club having a smart tag that stores a unique ID and data associated with the golf club;

a detection unit having a sensor that forms a detection zone, wherein the detection unit is raised above a ground plane; and a computing device configured to operate a golf club fitting program, wherein the smart tag is detected when located within the detection zone, and wherein the unique ID and the data associated with the golf club are transmitted to the computing device via the sensor for automatic entry into the golf club fitting program, wherein the sensor is adjustable to calibrate a radius R of the detection zone relative to a reference axis that is disposed at an angle relative to the ground plane.

11. The golf club fitting system of claim 10, wherein the smart tag is provided on at least one of a club head, a shaft, or a grip of the golf club.

12. The golf club fitting system of claim 11, wherein the smart tag is housed within the golf club.

13. The golf club fitting system of claim 10, wherein the smart tag is passive and obtains power from the detection unit.

14. The golf club fitting system of claim 10, wherein the detection unit is spaced apart from the sensor and the detection zone.

15. The golf club fitting system of claim 10, wherein the detection unit is a smartphone that is configured to operate a mobile application that, in response to detecting the smart tag within the detection zone, communicates with a remote database to display data associated with the golf club on a GUI.

16. The golf club fitting system of claim 15, wherein the GUI presents a menu of selectable options for a user.

17. A method of using a golf club fitting system, the method comprising the steps of:

providing a golf club having a smart tag;

providing a detection unit having a sensor, wherein the sensor defines a detection zone having a radius R extending about a reference axis that intersects the sensor;

adjusting the sensor to calibrate the radius R and/or an angle of the reference axis relative to a ground plane;

storing data associated with the golf club in the smart tag;

detecting the smart tag within the detection zone;

receiving an authentication from a user in response to a prompt from the detection unit;

receiving the data associated with the golf club from the smart tag via the sensor; and communicating the data associated with the golf club to a computer.

18. The method of claim 17, wherein the sensor is carried by the detection unit and a detection zone is located adjacent the detection unit, the smart tag is located in a club head of the golf club, and the smart tag is an NFC tag.

19. The method of claim 17, wherein the sensor defines the detection zone and is distanced from the detection unit, the smart tag is located in a shaft of the golf club, and the smart tag is a RFID tag.

* * * * *